US007901331B1

(12) United States Patent
Stoll

(10) Patent No.: US 7,901,331 B1
(45) Date of Patent: Mar. 8, 2011

(54) MULTI-BAR LINKAGE EXERCISE DEVICE

(76) Inventor: Henry William Stoll, Bellevue, WA (US)

( * ) Notice: Subject to any disclaimer, the term of this patent is extended or adjusted under 35 U.S.C. 154(b) by 0 days.

(21) Appl. No.: 12/631,422

(22) Filed: Dec. 4, 2009

(51) Int. Cl.
*A63B 22/04* (2006.01)
*A63B 22/06* (2006.01)
*A63B 23/08* (2006.01)

(52) U.S. Cl. ..... 482/52; 482/57; 482/60; 482/79

(58) Field of Classification Search ..... 482/51–54, 482/70–71, 79–80, 44–46, 62, 14, 146, 148; D21/662, 665, 685, 688
See application file for complete search history.

(56) References Cited

U.S. PATENT DOCUMENTS

| | | | | |
|---|---|---|---|---|
| 3,713,438 | A * | 1/1973 | Knutsen | 601/35 |
| 3,968,963 | A * | 7/1976 | Sileo | 482/57 |
| 4,570,927 | A * | 2/1986 | Petrofsky et al. | 482/60 |
| 4,643,419 | A * | 2/1987 | Hyde | 482/63 |
| 4,976,426 | A * | 12/1990 | Szabo et al. | 482/6 |
| 5,230,674 | A * | 7/1993 | Terauds | 482/52 |
| 5,230,676 | A * | 7/1993 | Terauds | 482/53 |
| 5,299,995 | A * | 4/1994 | Ko | 482/52 |
| 5,453,065 | A * | 9/1995 | Lien et al. | 482/52 |
| 5,490,824 | A * | 2/1996 | Wang | 482/60 |
| 5,807,210 | A * | 9/1998 | Devlin | 482/52 |
| 5,860,941 | A * | 1/1999 | Saringer et al. | 601/33 |
| 6,001,046 | A * | 12/1999 | Chang | 482/57 |
| 6,511,404 | B2 * | 1/2003 | Tu | 482/57 |
| 6,514,180 | B1 * | 2/2003 | Rawls | 482/70 |
| 6,709,367 | B1 * | 3/2004 | Liang | 482/53 |
| 6,949,054 | B1 * | 9/2005 | Stearns et al. | 482/52 |
| 7,048,675 | B1 * | 5/2006 | Liang | 482/53 |
| 7,137,928 | B1 * | 11/2006 | Chen | 482/53 |
| 7,314,431 | B1 * | 1/2008 | Korotiaev et al. | 482/51 |
| 7,530,927 | B2 * | 5/2009 | Chuang | 482/53 |
| 7,618,354 | B2 * | 11/2009 | Wu | 482/60 |
| 7,621,852 | B2 * | 11/2009 | Bowser | 482/57 |
| 2002/0086779 | A1 * | 7/2002 | Wilkinson | 482/118 |
| 2002/0147075 | A1 * | 10/2002 | Tu | 482/52 |
| 2003/0008750 | A1 * | 1/2003 | Liang | 482/53 |
| 2003/0022764 | A1 * | 1/2003 | Johnston | 482/57 |
| 2004/0043873 | A1 * | 3/2004 | Wilkinson et al. | 482/54 |
| 2004/0204294 | A2 * | 10/2004 | Wilkinson et al. | 482/54 |
| 2005/0070403 | A1 * | 3/2005 | Yu | 482/53 |
| 2006/0084553 | A1 * | 4/2006 | Chen | 482/53 |
| 2006/0240950 | A1 * | 10/2006 | Chang | 482/52 |
| 2007/0259757 | A1 * | 11/2007 | Chen | 482/53 |
| 2007/0298935 | A1 * | 12/2007 | Badarneh et al. | 482/52 |
| 2008/0032866 | A1 * | 2/2008 | Chang | 482/51 |
| 2008/0058168 | A1 * | 3/2008 | Lin | 482/52 |
| 2008/0146421 | A1 * | 6/2008 | Hsieh | 482/129 |

* cited by examiner

*Primary Examiner* — LoAn H. Thanh
*Assistant Examiner* — Robert F Long
(74) *Attorney, Agent, or Firm* — Chris Kuczynski

(57) ABSTRACT

In the embodiments and methods described, a device is employed having a first multi-bar linkage in mechanical communication with a frame. At least one mechanical input component is in mechanical communication with the multi-bar linkage. The multi-bar linkage is selectively adaptable to provide at least three different motions for the mechanical input component.

13 Claims, 7 Drawing Sheets

MULTI-BAR LINKAGE EXERCISE DEVICE

CROSS-REFERENCE TO RELATED APPLICATIONS

This application claims the benefit of U.S. Provisional Application Ser. No. 60/540,188 filed on Jan. 28, 2004, which is hereby incorporated by reference in its entirety and U.S. application Ser. No. 11/046,012 filed on Jan. 27, 2005, which is also hereby incorporated by reference in its entirety.

TECHNICAL FIELD

The embodiments of the invention described herein are generally directed to an exercise device.

BACKGROUND

Many known exercise machines are costly devices intended for use in gyms or other dedicated workout facilities. Because of their typically large size and weight, such devices are not generally portable and are not readily usable in areas such as a home living room or company office. Indeed such exercise machines are also typically dedicated to one kind of exercise motion. For example, an exercise bicycle involves circular rotation of foot pedals that are moved by the user's feet and legs. Alternatively, a treadmill involves a moving surface on which the user walks. Individuals burn calories by moving and it is not necessary to work up a sweat to burn calories.

Many known exercise devices are known that incorporate mechanical linkages. For example, a discussion of four bar linkages is found on the University of Notre Dame website, www.nd.edu, in AME 339 Kinematics and Dynamics of Machinery, Grashoffs Criterion. Also several prior art exercise devices using linkages are disclosed in the following U.S. patents: U.S. Pat. No. 4,824,10; U.S. Pat. No. 5,352,169; U.S. Pat. No. 5,836,854; U.S. Pat. No. 5,846,166; U.S. Pat. No. 5,865,712; U.S. Pat. No. 5,921,894; U.S. Pat. No. 6,454,682; and U.S. Pat. No. 6,468,184.

Many known exercise machines are relatively bulky and take up a lot of floor space. Such machines are often found at health clubs and gyms. Unfortunately, individuals are oftentimes too busy to go to a gym or a health club to exercise. As such, exercise devices have been developed that allow a user to exercise while working at a desk or sitting at home viewing TV. For example, U.S. Pat. No. 6,709,368 discloses a foot pedal exercise device that is amenable to being used while watching TV and can also be used at the office under the desk. Unfortunately, the exercise device disclosed in the '368 patent is a single function device. Users are known to become bored doing the same exercise all of the time. Moreover, multiple exercise devices are cumbersome and costly. Thus, there is a need for a multiple function exercise device that is amenable to be used in non-exercise environments, such as, at the office under a desk as well as at home while watching TV.

Therefore, it would be desirable to provide a relatively low cost, lightweight, portable, easy to use, quiet, and reliable exercise device for use in non-exercise environments, such as an office or home living room. The device should be configured so that the user can easily alternate the types of movement involved in order to exercise different muscle groups and to vary the exercise session so that it does not become overly tiring or boring. Optionally, an adjustable resistance device may be provided so that the user can match exercise effort with his or her personal exercise preferences and goals.

The exercise device should be configured as a small, reconfigurable lightweight multi-bar linkage that allows the position of various links to be rigidly fixed and other links to be rigidly connected to each other to selectively enable various modes of operation (i.e. exercise motions). These exercise motions may include: an "elliptical" motion, a "slider" motion, a "stepping" motion, and a "bicycle" motion to name a few. The "elliptical" motion is further divided into two options. The first "elliptical" option is provided when the user is standing above the exercise device where a "stepping elliptical" motion is achieved. The second "elliptical" motion is provided when the user is sitting. Depending on the size of the exercise device, the inertial resistance of the multi-bar linkage may be sufficient to provide a desired level of resistance to the exercise motion. If desired, the output shaft of the five-bar linkage may be connected to an inertial load such as a flywheel to provide additional resistance to the exercise motion.

Alternatively, the output shaft may be connected to an adjustable resistance device. Although it is possible to use a variety of different resistance devices, the once acceptable resistance device is a planetary gear train assembly that could be mounted in a frame and having a first input, a second input and an output, a mechanism for setting the second input to zero by fixing the second input to the frame, a mechanism for setting the output to zero by appropriate selection of the parameters of the output, so that when the output is loaded with an adjustable force or torque, the power or motion applied to the first input produces no output and is dissipated as frictional energy thereby providing resistance to the power or motion applied to the first input. This device is desired because of its small size, lightweight, ease of adjustability, reliability, quietness, and low cost. The user provides input motion to the device. The users legs and feet can provide the input motion. When operated by the user's legs and feet, the desired exerciser is positioned relative to a chair or couch in which the user sits and it is held and/or mounted so that it does not move under the action of the exercise forces. Alternatively, the exerciser may be placed on a table or other surface and operated by the user's hands and arms.

SUMMARY

In the embodiments and methods described, a device is employed having a first multi-bar linkage in mechanical communication with a frame. At least one mechanical input component is in mechanical communication with the multi-bar linkage. The multi-bar linkage is selectively adaptable to provide at least three different motions for the mechanical input component.

BRIEF DESCRIPTION OF THE DRAWINGS

The features and inventive aspects of the present invention will become more apparent upon reading the following detailed description, claims, and drawings, of which the following is a brief description:

DETAILED DESCRIPTION

Figure 1:
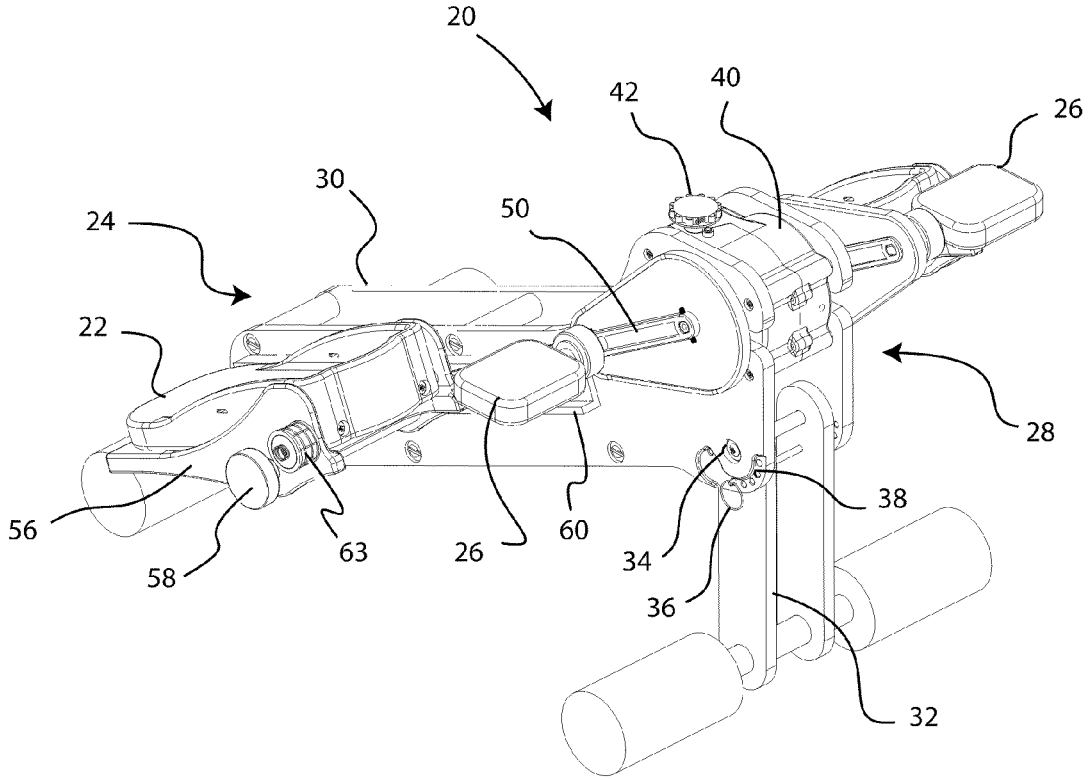
FIG. 1 is a front perspective view of an exercise device.

Referring now to the drawings, illustrative embodiments are shown in detail. Although the drawings represent the embodiments, the drawings are not necessarily to scale and certain features may be exaggerated to better illustrate and explain an innovative aspect of an embodiment. Further, the embodiments described herein are not intended to be exhaustive or otherwise limit or restrict the invention to the precise form and configuration shown in the drawings and disclosed in the following detailed description.

Figure 2:
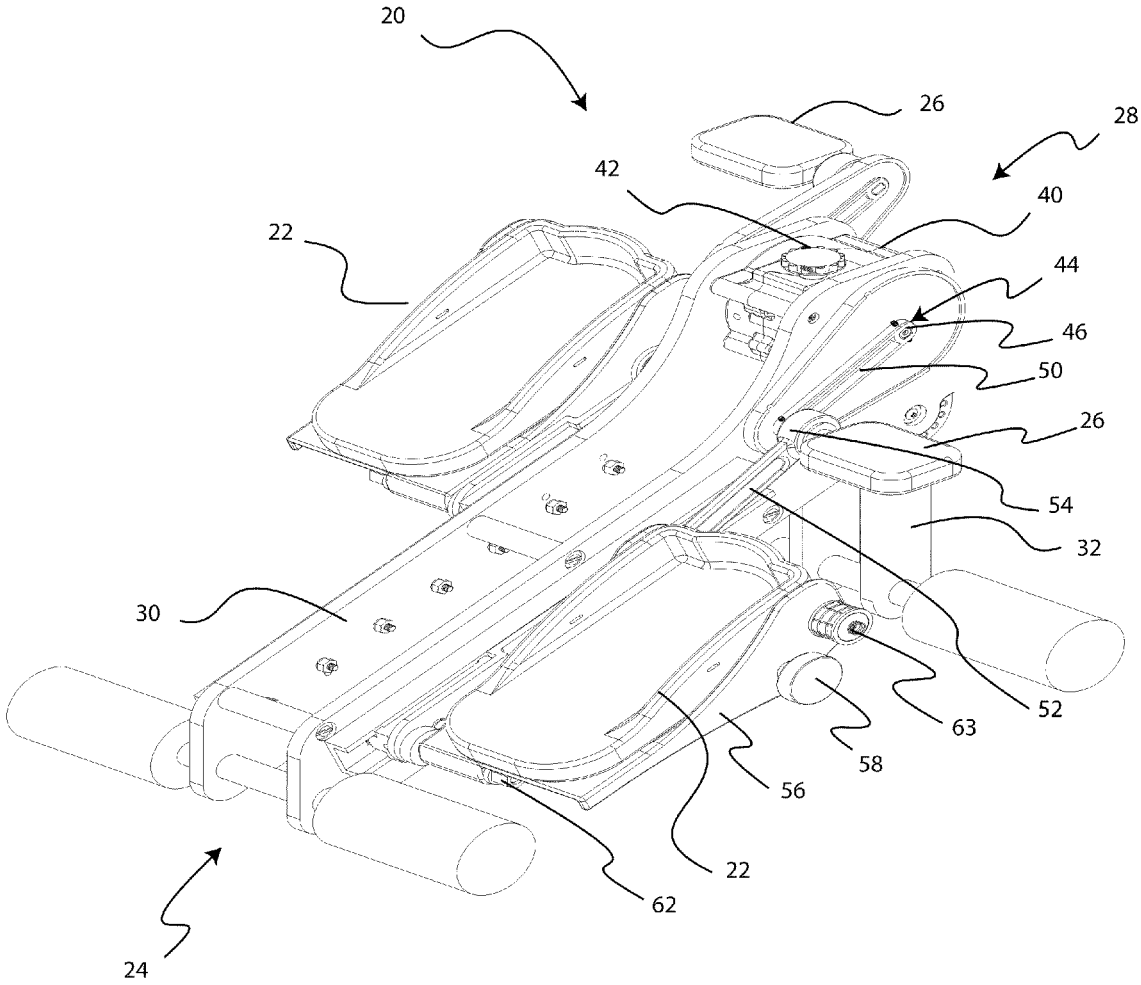
FIG. 2 is a rear perspective view of FIG. 1.
Figure 3:
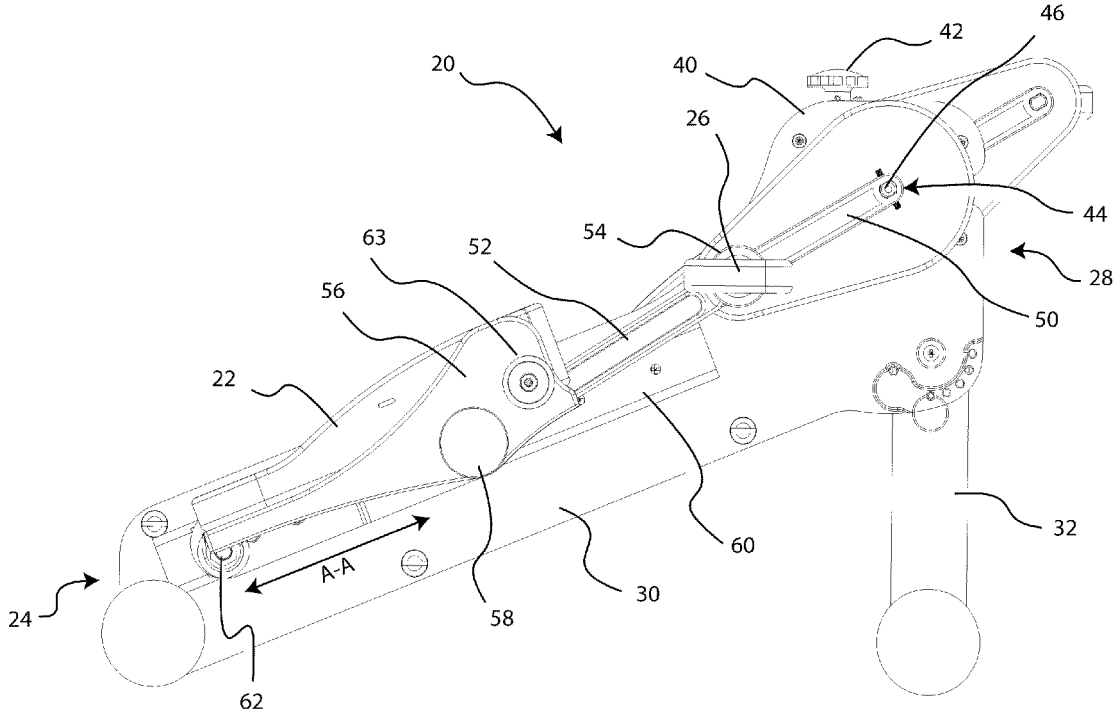
FIG. 3 is a side view of FIG. 1.

Referring now to FIGS. 1-3, a multi-bar linkage device is illustrated to produce motions that include: an "elliptical" motion, a "slider" motion, a "stepping" motion, and a "bicycle" motion of a manually operated exercise device 20. The "elliptical" motion generally forms a motion of an ellipse. The "slider" motion generally forms a linear back and forth motion with the user's foot moving forward and backward. The "slider" motion may be achieved at any selectively adjustable angle of incline. The "stepping" motion generally forms a linear up and down motion with the user's foot moving in a generally upward and a generally downward direction. The "stepping" motion may also be achieved at any selectively adjustable angle of incline. The "bicycle" motion generally forms a circular path.

The exercise device 20 includes foot pedals 22 at a first end 24 of the exercise device 20 adapted to produce multiple motions as discussed further below. A second set of removable pedals 26 are disposed at a second end 28 of the exercise device 20 are adapted for a rotational or "bicycle" motion. A frame 30 provides a rigid structure for the linkage mechanism and includes an incline feature whereby the user may adjust the height of the second end 28 by adjusting legs 32 to a desired angle. However, any height adjustment mechanism may be used. Legs 32 are secured to the frame 30 by a pivot joint 34 and fixed at a desired angle by pin 36 placed through any desired adjustment location 38. A resistance mechanism 40 is disposed between the pedals 26 for selectively adjusting the resistance of the desired motion. The resistance mechanism 40 is selectively adjusted by rotational knob 42. Any mechanical, electrical, or the like resistance mechanism is may be used.

A flywheel (not shown) may also be used in combination with the resistance mechanism 40 or as the resistance mechanism 40. In addition to providing resistance, the flywheel assists in smoothing the motion by providing momentum to the linkage (discussed further below) when it passes through dead points. Dead points occur when various links in the linkage line up in straight lines causing the lever arm of the force applied to the linkage by the user to become zero. Hence, no torque is transmitted to make the linkage turn, no matter how much force the user applies. If the resistance mechanism 40 such as a planetary gear device is used, the dead points becomes more pronounced because torque is now needed to overcome the resistance, but the user is unable to apply this torque when the links are in the dead point positions. As a result, the linkage is liable to stall or slow down appreciably as it passes through the dead points. The flywheel eliminates the dead points by supplying the torque needed to carry the linkage through the dead point.

The multi-bar mechanism includes a linkage on both sides of the frame 30. FIG. 3 illustrates one side of the multi-bar mechanism having a pivot 44 that is rigidly secured to the frame 30 and is aligned so that output shaft 46 disposed within the resistance mechanism 40 rotates in mechanical communication with the multi-bar linkage on the opposite side of the frame 30. The resistance mechanism 40 is journal mounted at pivot 44 and is free to rotate.

A first end of link 50 is in mechanical communication with output shaft 46 at pivot 44. A second end of link 50 is in mechanical communication with a first end of link 52 by a pivot joint 54. Pivot joint 54 allows link 50 to rotate with respect to link 52 about the pivot axis of pivot joint 54. In like manner, a second end of link 52 is in mechanical communication with a first end of link 56 by a pivot joint 58, which allows link 52 to rotate with respect to link 56. In like manner, a second end of link 56 is in mechanical communication with slider 60 by pivot joint 62, which allows link 56 to rotate with respect to slider 60. A portion of joint 62 is located within slider 60 that is mounted to the frame 30 so that it is free to slide in a straight line along the slider 60 longitudinal length axis A-A, but cannot rotate or move in any other direction relative to frame 30.

By virtue of connections 62, 58, 54, and 44, frame 30, link 50, link 52, link 56, and slider 60 form a multi-bar linkage having two-degrees of freedom, that is, a linkage requiring two input motions to produce a constrained and predictable output motion. As shown in FIG. 3, links 50, 52, 56, and slider 60 comprise one of two multi-bar linkages that comprise the exercise device. The other multi-bar linkage is formed by identical linkages on the opposite side of the exercise device 20. The multi-bar linkage comprised of links 50, 52, 56, and slider 60 is operated by a foot of the user, which pushes on foot pedal 22 or pedal 26 (when attached). As shown in FIG. 3, link 50 is rigidly mounted to output shaft 46 at different angular positions. These angular positions are adjusted so that, when the user is pushing on foot pedal 22 with his or her leg, opposite pedal 22 is being returned and when the user is pushing with his or her other foot on pedal 22, opposite pedal 22 is being returned. As shown in FIG. 3, the end of output shaft 46 is in mechanical communication with the resistance mechanism 40. One example of the resistance mechanism 40 includes a planetary gear train assembly that provides a resisting force against which the user works during the exercise session.

A "five-bar" linkage is described to produce different exercise motions. As discussed, the five-bar linkage has two degrees of freedom and therefore, the linkage motion is unconstrained, i.e., the motion is unpredictable. To make the motion predictable, we remove one of the freedoms by fixing various links relative to adjacent links to prevent relative motion between the links. Hence, the five-bar linkage is reduced to a four-bar linkage which has predictable motion because it has one degree of freedom. Different exercise motions are produced depending on which and how links are fixed. This is one of the novel features of the exercise device 20; different motions are obtained by creating different four-bar linkage combinations out of the starting unconstrained five-bar linkage.

The exercise device 20 linkages are provided by connecting links together using different types of "pairs." These include turning (revolute) pairs (a hinge is a turning pair as is a pivot), prismatic pairs (e.g. piston sliding in a cylinder), sliding pairs, spherical pairs (ball and socket joint), to name a few. The particular five-bar linkage of the exercise device 20 illustrated in FIGS. 1-7 is assembled using four turning and one sliding pairs. One of ordinary skill in the art will understand that a variety of different five-bar linkages can be created using different combinations of connecting pairs (a five-bar linkage connected together using three turning pairs, a sliding pair, and a ball and socket pair is one of many examples). Each of these different five-bar linkages can be converted into a four-bar mechanisms having constrained (predictable) motion as shown in FIGS. 1-7. One of ordinary skill will understand that this concept isn't limited to five-bar linkages either; six-bar, seven-bar, on up to n-bar linkages would all work as long as enough pairs are eventually fixed to produce a four-bar linkage having constrained motion.

Other exercise devices obtain different exercise motions by varying the geometry of the linkage, not by changing freedoms from the linkage. None of other exercise devices employ the concept of a linkage that provides multiple particular motions.

As stated previously, the multi-bar linkage comprised of links 50, 52, 56, and slider 60 has two degrees of freedom, that is, each linkage requires two input motions to produce a constrained and predictable output motion. By fixing one or more of the links in specific ways, one of the degrees of freedom is removed from the multi-bar linkage and only the input motion produced by the user pushing with his or her feet on foot pedals 22 is required to produce constrained and predictable rotary output motion of the output shaft 46. Different motions of the foot pedals 22 or pedals 26 (when attached) are achieved depending on how the links are fixed.

The exercise device 20 is configured as a small, reconfigurable lightweight multi-bar linkage that allows the position of various links to be in mechanical communication with other links to selectively enable various modes of operation (i.e. exercise motions). These exercise motions include: an "elliptical" motion, a "slider" motion, a "stepping" motion, and a "bicycle" motion to name a few.

Figure 4:
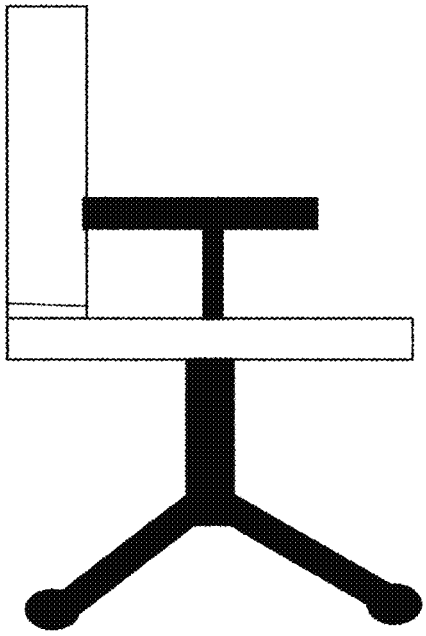
FIG. 4 is a side view of FIG. 1 and a chair.
Figure 4:
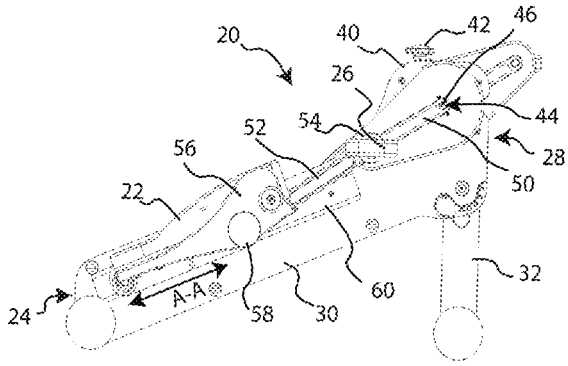

Accordingly, as shown in FIG. 3, by selectively fixing link 56 to frame 30 at pivot joint 58, link 56 is prevented from rotating in an "elliptical" motion and the multi-bar linkage is transformed to a to a "sliding" motion along the slider 60 longitudinal length axis A-A. When link 56 is fixed, the linkages that are formed result in an up-and-down "sliding" pedal motion along axis A-A. With this configuration, foot pedal 22 is constrained to move in a straight line along the longitudinal length of the slider 60. FIG. 4 illustrates one orientation of the exercise device 20 being placed in front of a typical chair. The exercise device 20 is small enough to fit under a typical desk for storage or exercise.

Referring to FIG. 4, the user's legs and feet can provide the input motion. When operated by the user's legs and feet, the desired exerciser is positioned relative to a chair or couch in which the user sits and it is held and/or mounted so that it does not move under the action of the exercise forces. Alternatively, the exerciser may be placed on a table or other surface and operated by the user's hands and arms.

Figure 5:
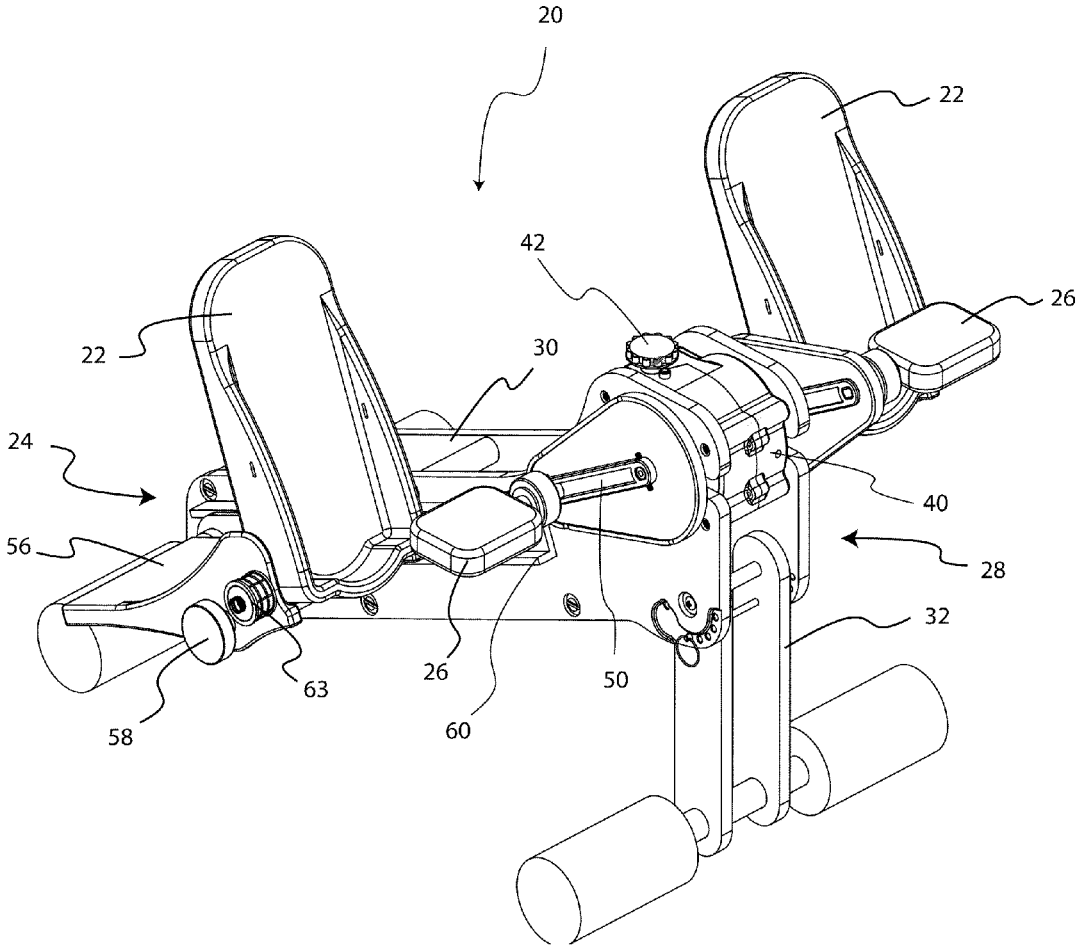
FIG. 5 is a front perspective view of the exercise device of FIG. 1 having the foot pedals angled at ninety degrees.

Referring now to FIG. 5, by tilting the foot pedals 22 at ninety degrees to link 56 so that the link 56 moves along slider 60 the up-and-down "stepping" pedal motion is achieved from the chair. The foot pedals 22 lock in place by pulling and fixing pin 63. The pedals 26 should be removed for this motion.

Further, other motions such as the "elliptical" motion can be achieved by bringing down the foot pedals 22 so that they rest on link 56 and unlocking pin 58 so that the joint between link 52 and line 56 may rotates freely. The user sitting at first end 24 will be provided with a minor "elliptical" motion. Bringing the foot pedals 22 to a ninety-degree angle with link 56 and sitting at second end 28, the user will be provided with a larger "elliptical" motion for exercise. Additionally, by increasing the number of adjustments as well as choosing the proper link lengths, other input motions can be achieved. By rotating the exercise device 20 so that the chair is near the second end 28 and the pedals 26 are attached so that the input motion duplicates the "circular" pedal motion used in an exercise bicycle.

Although not necessary for its basic operation, the exerciser may be equipped with a resistance mechanism 40 that generates a resistance force against which the user works to exercise. The resistance force maybe developed using inertia such as provided by a flywheel (not shown) mounted directly on the output shaft 46 or the inertia of the exercise device links themselves, electromagnetic resistance as in an electrical generator and motor set, friction as in a band brake, air resistance as in a wind turbine, or other convenient means. The resistance force may also be adjustable or fixed. Because of its small size and ease of adjustment, a particularly suitable resistance device is the planetary resistance device disclosed in U.S. Pat. No. 7,115,072, hereby incorporated by reference. Other adjustable and non-adjustable resistance devices are also suitable, such as the adjustable resistance device disclosed in U.S. Pat. No. 6,709,368, hereby incorporated by reference.

Figure 6:
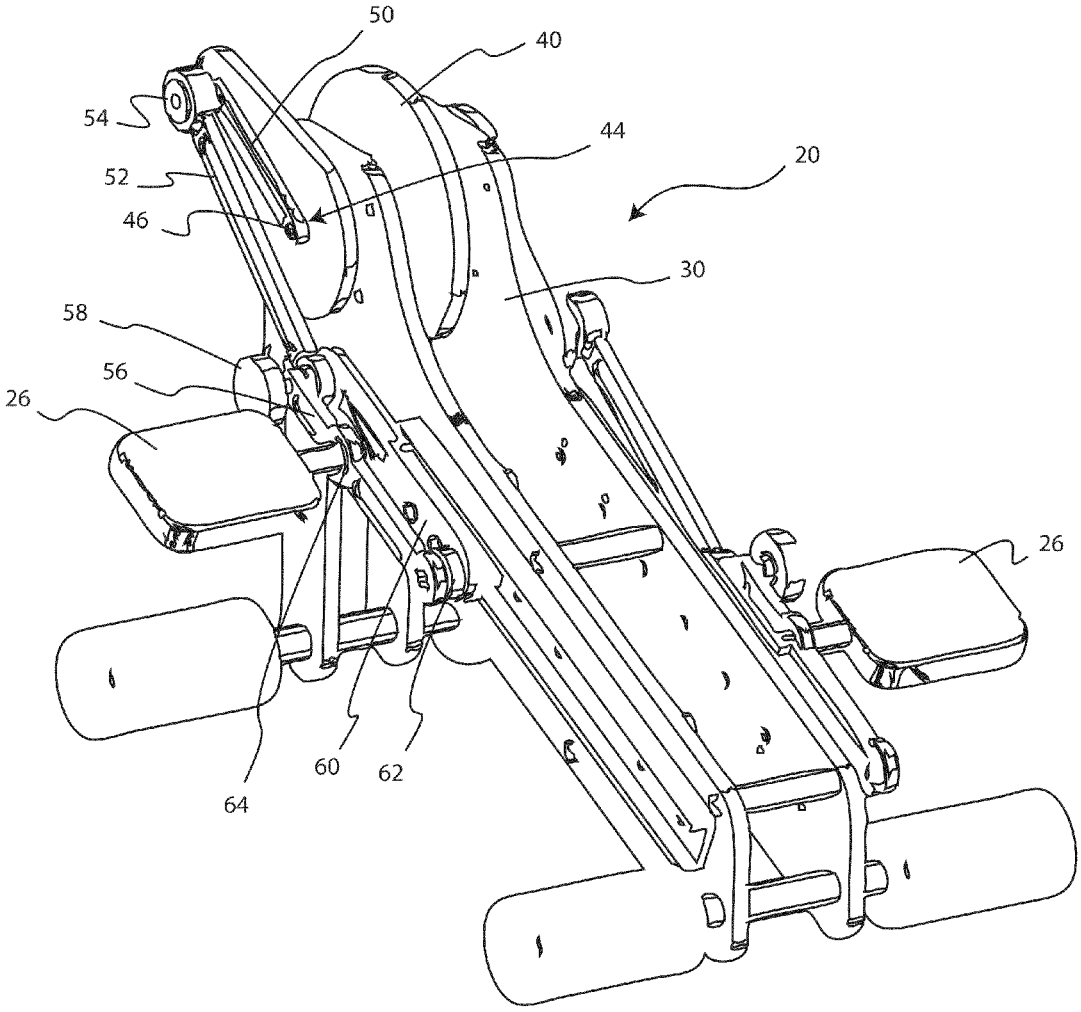
FIG. 6 is a rear perspective view of a second embodiment of the exercise device having the foot pedals replaced by smaller pedals.
Figure 7:
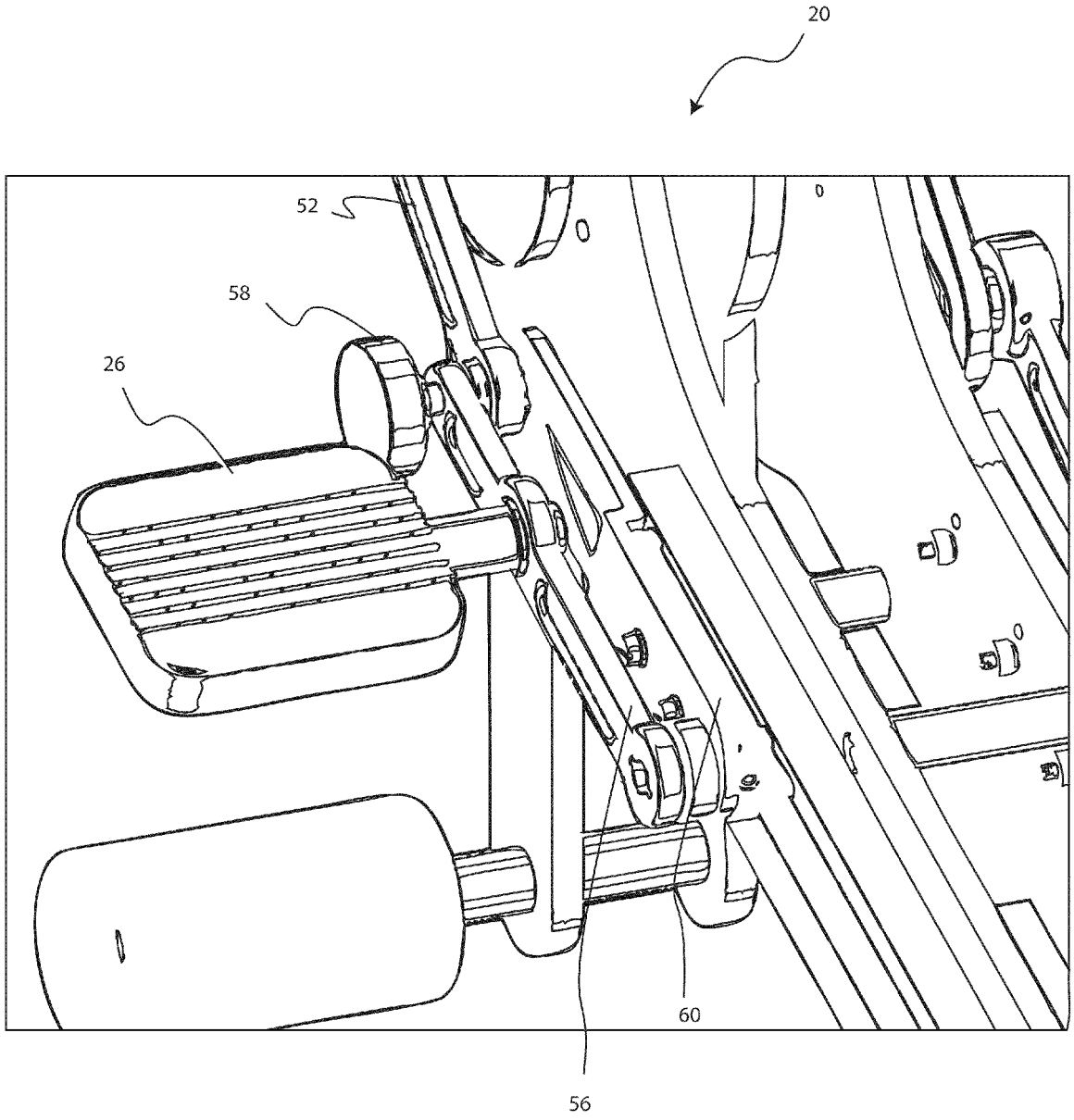
FIG. 7 is a detailed view of the pedal area of FIG. 6.

Referring to FIGS. 6-8, a second embodiment of the description is illustrated having pedals 26 attached to link 56 at pivot 64. The description of the second embodiment is incorporated in the paragraphs above. The new feature in the second embodiment is that pedals 26 are adapted to be selectively removable and attachable to either pivot 64 or pivot 54. When pedals 26 are attached to pivot 54 the "bicycle" motion is provided. When pedals 26 are attached to pivot 64 and pivot joint 58 attaches links 52 and 56 to slider 60, the "slider" and "stepping" motion is provided. When pedals 26 are attached to pivot 64 and pivot joint 58 does not attached links 52 and 56 to slider 60, the "elliptical" motion is provided. In addition, one example of the resistance mechanism 40 is shown as a flywheel.

Once again referring to FIGS. 1-3, the device 20 includes the multi-bar linkage comprising links 50, 52, 56, and slider 60 in mechanical communication with the frame 30. At least one mechanical input component shown as foot pedal 22 and pedal 26 is in mechanical communication with the multi-bar linkage. The multi-bar linkage is selectively adaptable to provide at least three different motions for the mechanical input component. Both the foot pedal 22 and the pedal 26 are adapted to be used from a sitting position as shown in FIG. 4. The at least three different motions include but are not limited to an elliptical motion, a sliding motion, a stepping motion and a bicycle motion. The multi-bar linkage is in communication with the selective resistance device 40. In one exemplary embodiment, the selective resistance device 40 is a flywheel. In another exemplary embodiment the selective resistance device 40 is a planetary gear arrangement.

Again, the device 20 includes the frame 30 in mechanical communication with the first multi-bar linkage on one side of the frame 30. The first multi-bar linkage is in communication with a second multi-bar linkage on the other side of frame 30. A first mechanical input component such as the foot pedal 22, the pedal 26, and the like is in mechanical communication with the first multi-bar linkage. A second mechanical input component is in mechanical communication with the second multi-bar linkage. The first multi-bar linkage and the second multi-bar linkage are selectively adaptable to provide at least three different motions for the first mechanical input component and the second mechanical input component.

A method includes placing the frame 30 in mechanical communication with the first multi-bar linkage. Then place the first multi-bar linkage in communication with the second multi-bar linkage. Attach the first mechanical input component to a portion of the first multi-bar linkage. Attach the second mechanical input component to a portion of said second multi-bar linkage. The first multi-bar linkage and the second multi-bar linkage are adapted to be selectively moveable to provide at least three different motions for the first mechanical input component and the second mechanical input component. The foot pedals 22 and pedals 26 are adapted to be used from a sitting position. In one exemplary embodiment, a step includes placing a selective resistance device between the first multi-bar linkage the second multi-bar linkage.

The preceding description has been presented only to illustrate and describe exemplary embodiments of the methods and systems of the present invention. It is not intended to be exhaustive or to limit the invention to any precise form disclosed. It will be understood by those skilled in the art that various changes may be made and equivalents may be substituted for elements thereof without departing from the scope of the invention. In addition, many modifications may be made to adapt a particular situation or material to the teachings of the invention without departing from the essential scope. Therefore, it is intended that the invention not be limited to the particular embodiment disclosed as the best mode contemplated for carrying out this invention, but that the invention will include all embodiments falling within the scope of the claims. The invention may be practiced otherwise than is specifically explained and illustrated without departing from its spirit or scope. The scope of the invention is limited solely by the following claims.

What is claimed is:

1. An exercise device comprising:

a multi-bar linkage in mechanical communication with a frame;

two pairs of left and right pedals component in mechanical communication with said multi-bar linkage; said linkage comprising respective left and right linkage interconnecting said respective two pairs of left and right pedals wherein said multi-bar linkage is to provide at least three different motions for said respective two pairs of left and right pedals; and wherein said at least three different motions include an elliptical motion, a sliding motion, a stepping motion and a circular motion; and wherein one pair of the respective two pairs of left and right pedals solely provides a circular motion.

2. The device of claim 1 wherein said device is adapted to be used from a sitting position.

3. The device of claim 1 wherein said multi-bar linkage is in communication with a selective resistance device.

4. The device of claim 3 wherein said selective resistance device is a flywheel.

5. The device of claim 3 wherein said selective resistance device is a planetary gear arrangement.

6. A device comprising:

A frame in mechanical communication with a first multi-bar linkage; said first multi-bar linkage is in communication with a second multi-bar linkage;

a left pair of pedals is in mechanical communication with said first multi-bar linkage;

a right pair of pedals is in mechanical communication with said second multi-bar linkage;

wherein said first multi-bar linkage and said second multi-bar linkage are to provide at least three different motions for said first respective two pairs of left and right pedals;

wherein said at least three different motions are selected from a group consisting of any three of the following motions: an elliptical motion, a sliding motion, a stepping motion and a circular motion; and wherein one pair of the respective two pairs of left and right pedals solely provides a circular motion; and wherein said sliding motion is along a longitudinal axis of a fixed portion of said frame.

7. The device of claim 6 wherein said device is adapted to be used from a sitting position.

8. The device of claim 6 wherein said multi-bar linkages are in communication with a selective resistance device.

9. The device of claim 8 wherein said selective resistance device is a flywheel.

10. The device of claim 8 wherein said selective resistance device is a planetary gear arrangement.

11. A method comprising:

placing a frame in mechanical communication with a first multi-bar linkage; placing said first multi-bar linkage in communication with a second multi-bar linkage;

attaching a left pair of pedals to a portion of said first multi-bar linkage;

attaching a right pair of pedals to a portion of said second multi-bar linkage;

adapting said first multi-bar linkage and said second multi-bar linkage to be selectively moveable to provide at least three different motions for said respective two pairs of left and right pedals; and wherein said at least three different motions include an elliptical motion, a sliding motion, a stepping motion and a circular motion; and wherein one pair of the respective two pairs of left and right pedals solely provides a circular motion.

12. The method of claim 11 wherein said respective two pairs of left and right pedals are adapted to be used from a sitting position.

13. The method of claim 11 further placing a selective resistance device between said first multi-bar linkage and said second multi-bar linkage.

* * * * *